US012029255B2

(12) United States Patent
Qiu et al.

(10) Patent No.: US 12,029,255 B2
(45) Date of Patent: Jul. 9, 2024

(54) ELECTRONIC CIGARETTE CONTROL METHOD AND DEVICE, AND ELECTRONIC CIGARETTE

(71) Applicant: CHANGZHOU PATENT ELECTRONIC TECHNOLOGY CO., LTD, Changzhou (CN)

(72) Inventors: Weihua Qiu, Jiangsu (CN); Yong Xiong, Jiangsu (CN); Guangxian Huang, Jiangsu (CN)

(73) Assignee: CHANGZHOU PATENT ELECTRONIC TECHNOLOGY CO., LTD, Changzhou (CN)

( * ) Notice: Subject to any disclaimer, the term of this patent is extended or adjusted under 35 U.S.C. 154(b) by 595 days.

(21) Appl. No.: 17/244,997

(22) Filed: Apr. 30, 2021

(65) Prior Publication Data

US 2021/0251298 A1 Aug. 19, 2021

Related U.S. Application Data

(63) Continuation-in-part of application No. PCT/CN2019/114801, filed on Oct. 31, 2019.

(30) Foreign Application Priority Data

Nov. 2, 2018 (CN) ..... 201811298985.5
Nov. 2, 2018 (CN) ..... 201811299026.5

(51) Int. Cl.
*A24F 40/57* (2020.01)
*A24F 40/10* (2020.01)
(Continued)

(52) U.S. Cl.
CPC ..... *A24F 40/57* (2020.01); *A24F 40/10* (2020.01); *A24F 40/42* (2020.01); *A24F 40/51* (2020.01); *A24F 40/53* (2020.01)

(58) Field of Classification Search
CPC ..... A24F 40/57; A24F 40/10; A24F 40/42; A24F 40/51; A24F 40/53; A24F 40/50; A24F 15/015
See application file for complete search history.

(56) References Cited

U.S. PATENT DOCUMENTS 10,687,557 B2 * 6/2020 Tucker ..... A24F 47/00
2017/0146005 A1 * 5/2017 Edelen ..... A24F 40/50
(Continued)

FOREIGN PATENT DOCUMENTS

CN 103859603 A 6/2014
CN 106579567 A 4/2017
(Continued)

OTHER PUBLICATIONS

The extended European search report of EP application No. 19878644.4 issued on Jul. 21, 2022.
(Continued)

*Primary Examiner* — Jean F Duverne
(74) *Attorney, Agent, or Firm* — Andrew C. Cheng

(57) ABSTRACT

An electronic cigarette control method, an electronic cigarette control device and an electronic cigarette using the control method and the control device are provided. The control method includes: determining the suction force indication information according to the information detected by a detecting assembly, wherein the detecting assembly includes a first air pressure detecting member arranged in an air passage in communication with a mouthpiece; determining the target value of a working parameter of an atomizer according to the suction force indication information, wherein the working parameter includes at least one of the output power, the temperature in an atomizing chamber, the working voltage of the atomizer, and the temperature of a heating member; and controlling the atomizer to work according to the target value of the working parameter. The
(Continued)

control method can adjust the output power, so that the user can obtain different smoking tastes.

8 Claims, 6 Drawing Sheets

(51) Int. Cl.
*A24F 40/42* (2020.01)
*A24F 40/51* (2020.01)
*A24F 40/53* (2020.01)

(56) References Cited

U.S. PATENT DOCUMENTS

2020/0315261 A1* 10/2020 Hubbard ..... A61M 11/042
2021/0011086 A1* 1/2021 Meadows ..... H01M 10/4285

FOREIGN PATENT DOCUMENTS

CN 206354451 U 7/2017
CN 107455799 A 12/2017
CN 107495478 A 12/2017
CN 108158044 A 6/2018
CN 108271405 A 7/2018
CN 108294363 A 7/2018
CN 108464527 A 8/2018
CN 108514155 A 9/2018
CN 108608366 A 10/2018
CN 207948913 U 10/2018
CN 209489499 U 10/2019
GB 2525080 A 10/2015
WO 2016082136 A1 6/2016
WO 2017118347 A1 7/2017

OTHER PUBLICATIONS

The second office action with translation of CN application No. 201811299026.5 issued on May 24, 2021.
Office Action with Search Report of Chinese Patent Application No. 201811299026.5 issued on Sep. 24, 2020.
International Search Report of PCT Patent Application No. PCT/CN2019/114801 issued on Jan. 23, 2020.

* cited by examiner

ELECTRONIC CIGARETTE CONTROL METHOD AND DEVICE, AND ELECTRONIC CIGARETTE

CROSS-REFERENCE TO RELATED APPLICATIONS

This application is a continuation-in-part of International Patent Application No. PCT/CN2019/114801, filed on Oct. 31, 2019, entitled "electronic cigarette control method and device, and electronic cigarette", which claims priority to Chinese Patent Applications Nos. 201811299026.5 and 201811298985.5, filed on Nov. 2, 2018. The aforementioned patent applications are hereby incorporated by reference in their entireties.

TECHNICAL FIELD

The present disclosure relates to the technical field of electronic cigarette, and more particularly, relates to an electronic cigarette control method, device and an electronic cigarette.

BACKGROUND

An electronic cigarette is an electronic product that imitates a cigarette, which can generate smoke through an atomizing substrate (such as e-liquid), and the smoke can be inhaled by the user from the mouthpiece to achieve the purpose of simulating smoking.

Small cigarettes are a common type of electronic cigarette products, which are small in size and usually only set with a cigarette lighting button for cigarette lighting. When the small cigarette detects the cigarette lighting signal generated by pressing the cigarette lighting button, it controls the internal heating member to generate heat according to the output power of the small cigarette which is preset when it leaves the factory. Since the small cigarette only works to atomize the atomizing substrate according to the preset output power, and the user cannot adjust it, the smoking taste of the small cigarette is single.

SUMMARY

In view of the above, it is necessary to provide an electronic cigarette control method, a control device, and an electronic cigarette that can adjust the output power of the power supply.

The technical solutions adopted by the present disclosure to solve its technical problems are as follows.

An electronic cigarette control method is provided, and the control method includes:

An electronic cigarette control method includes:

determining the suction force indication information according to the information detected by a detecting assembly, wherein the detecting assembly includes a first air pressure detecting member arranged in an air passage in communication with a mouthpiece;

determining the target value of a working parameter of an atomizer according to the suction force indication information, wherein the working parameter includes at least one of the output power, the temperature in an atomizing chamber, the working voltage of the atomizer, and the temperature of a heating member; and controlling the atomizer to work according to the target value of the working parameter.

Further, said determining the target value of a working parameter of an atomizer according to the suction force indication information includes:

if the suction force indication information is greater than a start threshold and is lower than an upper threshold, then the target value of the working parameter is determined according to a first value, a second value, the start threshold, the upper threshold and the suction force indication information;

and/or, if the suction force indication information reaches the upper threshold, then the second value is determined as the target value of the working parameter;

wherein the first value is greater than or equal to a minimum value of the working parameter that the electronic cigarette can atomize the e-liquid, the second value is less than or equal to a maximum value of the working parameter supported by the electronic cigarette, and the second value is greater than the first value.

Further, said determining the target value of the working parameter according to the first value, the second value, the start threshold, the upper threshold and the suction force indication information includes:

determining the target value of the working parameter according to a predetermined formula, and the predetermined formula is:

$$W_3 = m\frac{W_2 - W_1}{B - A}(K - A) + W_1 + C$$

wherein $W_3$ is the target value of the working parameter, $W_1$ is the first value, $W_2$ is the second value, A is the start threshold, B is the upper threshold, K is the suction force indication information, m is not zero and is a constant, and C is a constant.

Further, before determining the target value of the working parameter of the atomizer according to the suction force indication information, the control method further includes:

determining a preset initial value of the working parameter as the target value of the working parameter when the electronic cigarette is turned on; and/or said determining the target value of the working parameter of the atomizer according to the suction force indication information includes:

if the suction force indication information is greater than an adjustment threshold, the target value of the working parameter is increased.

Further, the detecting assembly further includes a second air pressure detecting member configured for detecting the atmospheric pressure, said determining the target value of the working parameter of the atomizer according to the suction force indication information further includes:

acquiring the atmospheric pressure detected by the second air pressure detecting member;

determining at least one of the first value, the second value, the start threshold and the upper threshold;

wherein the first value is positively correlated with the atmospheric pressure, the second value is positively correlated with the atmospheric pressure, the start threshold is positively correlated with the atmospheric pressure, and the upper threshold is positively correlated with the atmospheric pressure.

Further, said determining the suction force indication information according to the information detected by the detecting assembly includes:

acquiring the first air pressure value detected by the first air pressure detecting member, and then determining the suction force indication information according to the first air pressure value and the atmospheric pressure; or, acquiring the air pressure value detected by the first air pressure detecting member to obtain the suction force indication information.

Further, said determining the suction force indication information according to the first air pressure value and the atmospheric pressure includes:

calculating the difference between the first air pressure value and the atmospheric pressure value to obtain the air pressure difference;

determining the air pressure difference as the suction force indication information; or, calculating the difference between the air pressure difference and a calibrated air pressure value to obtain the suction force indication information, wherein the calibrated air pressure value is the air pressure difference between the air pressure in the air passage which is in communication with the mouthpiece and the atmospheric pressure when the atomizer stops working.

Further, before said determining the suction force indication information according to the information detected by the detecting assembly, the method further includes:

acquiring the atmospheric pressure last detected by the second air pressure detecting member, wherein the electronic cigarette uses the second air pressure detecting member to detect the atmospheric pressure every predetermined period of time.

Further, said controlling the atomizer to work according to the target value of the operating parameter includes:

when the suction force indication information reaches a start threshold, controlling the atomizer to work according to the target value of the working parameter; or when a cigarette lighting signal generated by operating a cigarette lighting button provided on the electronic cigarette is detected, controlling the atomizer to perform atomization work.

A computer-readable storage medium is provided with one or more instructions stored therein. When the one or more instructions are executed by a processor in an electronic cigarette, the electronic cigarette control method as described above is performed.

A control device for an electronic cigarette is provided, and the control device includes:

a memory and a processor;

wherein the memory stores therein at least one instruction;

the processor, by loading and executing the at least one instruction, implements the electronic cigarette control method as described above.

An electronic cigarette includes a casing assembly; an atomizing head, a sensing passage, a control board, a battery and a first air pressure detecting member are arranged in the casing assembly; the battery, the atomizing head and the first air pressure detecting member are each electrically connected to the control board; a detection end of the first air pressure detecting member is arranged in the sensing passage for detecting the air pressure value p1 in the sensing passage; the casing assembly is provided with a mouthpiece in communication with the sensing passage, when smoking through the mouthpiece, the control board adjusts the output power of the battery to the atomizing head according to the difference between the air pressure value p1 in the sensing passage detected by the first air pressure detecting member and an atmospheric pressure value p2 of the atmospheric pressure.

Further, said the control board adjusting the output power of the battery to the atomizing head according to the difference between the air pressure value p1 in the sensing passage detected by the first air pressure detecting member and the atmospheric pressure value p2 of the atmospheric pressure, includes:

determining the output power of the atomizing head according to a predetermined formula, and the predetermined formula is:

$$W_3 = m\frac{W_2 - W_1}{B - A}(K - A) + W_1 + C$$

wherein $W_3$ is the output power of the atomizing head, $W_1$ is a first value, $W_2$ is a second value, A is a start threshold, B is an upper threshold, K is the difference between the air pressure value p1 in the sensing passage detected by the first air pressure detecting member and the atmospheric pressure value p2 of the atmospheric pressure, m is not zero and is a constant, and C is a constant; the first value is greater than or equal to a minimum value of the output power that the electronic cigarette can atomize the e-liquid, the second value is less than or equal to a maximum value of the output power supported by the electronic cigarette, and the second value is greater than the first value.

Further, a memory is provided on the control board, the atmospheric pressure value p2 of the atmospheric pressure is stored in the memory; or, a receiver is provided on the control board, the receiver receives the atmospheric pressure value p2 sent from an external device; or, the electronic cigarette further includes a second air pressure detecting member, the second air pressure detecting member is in communication with the outside atmosphere and detects the atmospheric pressure value p2 of the atmospheric pressure.

Further, the electronic cigarette includes a cartridge and a battery assembly; the cartridge includes a cartridge casing, the battery assembly includes a battery casing, the cartridge casing and the battery casing together form the casing assembly; the atomizing head is received in the cartridge casing; the battery, the control board, the first air pressure detecting member and the second air pressure detecting member are all received in the battery casing; the mouthpiece is arranged at one end of the cartridge casing; one end of the cartridge casing opposite to the mouthpiece is detachably inserted into the battery casing to cause the cartridge to be detachably connected with the battery assembly.

Further, a sensing cavity is provided in the cartridge casing along the axial direction of the cartridge casing, the battery assembly further includes an airtight member, the airtight member is provided with a communication passage, the communication passage has an opening; when the cartridge is connected to the battery assembly, the opening of the communication passage is aligned with and in communication with the sensing cavity; the first air pressure detecting member is installed on the control board and the detection end of the first air pressure detecting member is arranged in the communication passage, the sensing passage includes the sensing cavity and the communication passage.

Further, a liquid storage chamber which is isolated from the sensing cavity is further provided in the cartridge casing along the axial direction of the cartridge casing; the cartridge further includes a sealing member arranged at one end of the cartridge casing opposite to the mouthpiece and configured for sealing the liquid storage chamber; one end of the cartridge casing opposite to the sealing element is provided with a smoke outlet hole, the mouthpiece is provided with a smoke outlet opening, the sensing cavity is in communication with the smoke outlet opening through the smoke outlet hole.

Further, the cartridge further includes an inner lining member provided at one end of the cartridge casing opposite to the mouthpiece, the inner lining member is located below the sealing member, an air passage gap is formed between the inner lining member and the sealing member, a communication cavity is provided in the side wall of the cartridge casing opposite to the sensing cavity, the cartridge casing is further provided with an air inlet hole in communication with the communication cavity, the atomizing head is at least partially received in the liquid storage chamber, the atomizing head is provided with an atomizing chamber, one end of the air passage gap is in communication with the communication cavity, and the other end of the air passage gap is in communication with the atomizing chamber.

Further, a receiving chamber is provided in the battery casing, the cartridge casing is partially received in the receiving chamber, the outer wall of the cartridge casing is protruded to provide with a protrusion, the protrusion abuts against the inner wall of the battery casing, a ventilation gap is formed between the outer wall of the cartridge casing and the inner wall of the battery casing; the ventilation gap is in communication with the external atmosphere and the air inlet hole.

Further, the cartridge further includes a bottom base installed at one end of the cartridge casing opposite to the mouthpiece and located below the inner lining member, and a first electrode and a second electrode; the atomizing head includes a liquid guiding member and a heating member which are in contact with each other; one end of the first electrode extends through the bottom base and the inner lining member in sequence, and is inserted into the sealing member and is electrically connected to one pin of the heating member; one end of the second electrode extends through the bottom base and the lining member in sequence, and is inserted into the sealing member and is electrically connected to the other pin of the heating member.

Further, a USB socket is installed on the control board, a USB connection port is provided on the battery casing, the second air pressure detecting member is in communication with the outside atmosphere through the USB socket and the USB connection port in sequence.

The beneficial effects of the present disclosure are: in the control method provided by the embodiment of the present disclosure, the suction force indication information is determined according to the information detected by the detecting assembly, wherein the detecting assembly includes the first air pressure detecting member arranged in the air passage communicated with the mouthpiece; the target value of the working parameter of the atomizer is determined according to the suction force indication information, wherein the working parameter includes at least one of the output power, the temperature in the atomizing chamber, the working voltage of the atomizer, and the temperature of the heating member; and the atomizer is controlled to work according to the target value of the working parameter, so as to solve the problem in the related art that the small cigarette heats and atomizes according to the preset output power to cause a single smoking taste, and accordingly achieve the effect of enriching the smoking taste of the small cigarette.

Figure 1:
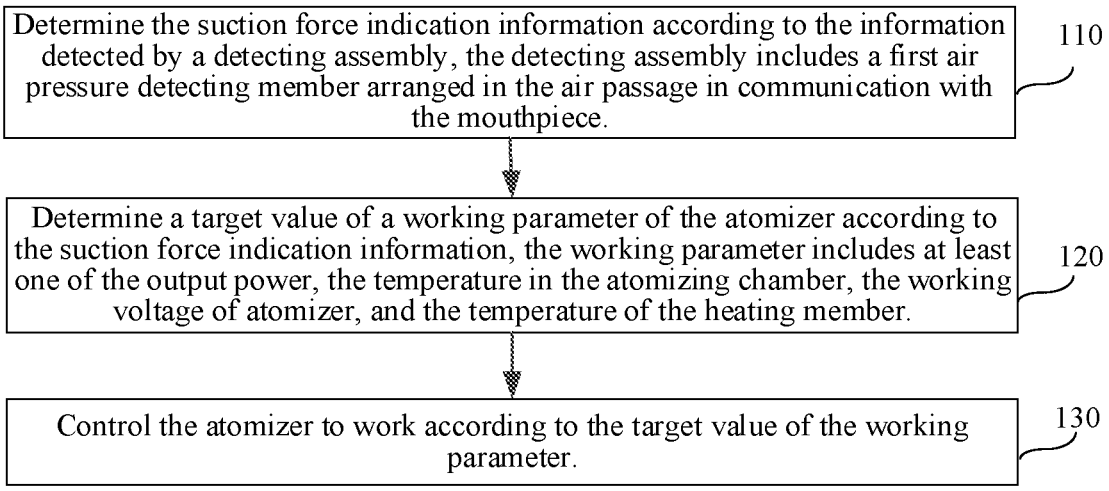
FIG. 1 is a flowchart of an electronic cigarette control method provided by the first embodiment of the present disclosure.

The reference numerals for various components in the drawings are as follows:

| | | |
|---|---|---|
| cartridge 100 | liquid storage chamber 110 | cartridge casing 11 |
| smoke outlet hole 111 | connecting pipe 112 | liquid injection opening 113 |
| sealing plug 114 | connecting portion 1141 | fixing portion 1142 |
| sealing portion 1143 | sensing cavity 115 | communication cavity 116 |
| air inlet hole 117 | connecting barrel 118 | sliding guide rib 119 |
| protrusion 1101 | ventilation gap 1102 | liquid storage assembly 10 |
| sealing member 12 | ventilation tube 13 | smoke outlet passage 130 |
| ventilation section 131 | sleeve section 132 | liquid inlet hole 133 |
| atomizing head 20 | liquid guiding member 21 | heating member 22 |
| atomizing chamber 210 | bottom base 30 | second through hole 301 |
| second magnetic member 302 | mouthpiece 40 | smoke outlet opening 401 |
| inner lining member 50 | air passage gap 510 | first through hole 501 |
| first electrode 60 | second electrode 70 | battery assembly 200 |
| battery casing 201 | receiving chamber 2011 | guiding groove 2012 |
| first shell 2013 | second shell 2014 | fixing plate 2015 |
| air guiding post 2016 | air guiding hole 2017 | first magnetic member 2018 |
| control board 202 | first terminal 2021 | second terminal 2022 |
| battery 203 | USB socket 209 | partition plate 205 |

-continued

| | | |
|---|---|---|
| airtight member 206 | longitudinal connecting block 2061 | horizontal connecting block 2062 |
| mounting groove 2063 | opening 2064 | mounting hole 2065 |
| communication opening 2066 | cover plate 2067 | first air pressure detecting member 207 |
| second air pressure detecting member 208 | | |

DETAILED DESCRIPTION OF PREFERRED EMBODIMENTS

The present disclosure will now be described in detail with reference to the drawings. These drawings are simplified schematic diagrams, which only illustrate the basic structure of the present disclosure in a schematic way, so it only shows the construction related to the present disclosure.

First Embodiment

Please refer to FIG. 1, which shows a flowchart of an electronic cigarette control method provided by one embodiment of the present disclosure. As shown in FIG. 1, the electronic cigarette control method includes:

Step 110: determining the suction force indication information according to the information detected by a detecting assembly, wherein the detecting assembly includes a first air pressure detecting member arranged in an air passage in communication with a mouthpiece.

This step can be implemented in the following methods:

The first method is to acquire the first air pressure value detected by the first air pressure detecting member to obtain the suction force indication information, which is used to indicate the suction force of the user.

In the second method, the influence factors of the first air pressure value detected by the first air pressure detecting member include not only the user's suction force, but also the current atmospheric pressure. The first air pressure value detected by the first air pressure detecting member cannot accurately reflect the user's suction force. The first air pressure value detected by the first air pressure detecting member needs to be combined with the current atmospheric pressure in order to accurately reflect the suction force of the user. In the second method, the first air pressure value detected by the first air pressure detecting member is firstly acquired, and the suction force indication information is then obtained according to the first air pressure value and the atmospheric pressure.

Specifically, the atmospheric pressure can be obtained in the following ways:

(1). A reference atmospheric pressure stored in the electronic cigarette is obtained as the atmospheric pressure;

(2). A second air pressure detecting member is provided in the electronic cigarette, and the atmospheric pressure value detected by the second air pressure detecting member is acquired. The second air pressure detecting member is disposed in the electronic cigarette at a position not communicated with the mouthpiece of the electronic cigarette. When inhaling, the airflow generated by the suction cannot be detected by the second air pressure detecting member to ensure that the second air pressure detecting member accurately detects the atmospheric pressure value without being affected by the user's suction at the mouthpiece. For example, the second air pressure detecting member can be provided on the control board in the electronic cigarette.

(3). A query request is sent to a mobile device within a wireless communication range, the query request is used to trigger the mobile device to use positioning technology to obtain its location information, and the atmospheric pressure value at its location is determined according to the location information, and then, the electronic cigarette receives the query result carrying the atmospheric pressure value sent by the mobile device.

(4). The electronic cigarette uses positioning technology to obtain its location information, and sends a query request carrying the location information to the server. The server queries the atmospheric pressure value corresponding to the location information, and sends the query result carrying the atmospheric pressure value to the electronic cigarette.

The wireless communication range is the communication range supported by the electronic cigarette using wireless communication technology, and the wireless communication technology mentioned herein can be any one of Bluetooth, NFC (Near Field Communication), and infrared. The positioning technology can be GPS (global positioning system) technology, Wi-Fi (Wireless-Fidelity, wireless fidelity) positioning technology, etc., which is not specifically limited in this embodiment.

For example, when an electronic cigarette is turned on, it uses Bluetooth technology to scan mobile devices within its wireless communication range and sends a query request to the mobile device. After the mobile device receives the query request, it uses GPS technology to locate its geographic coordinates, and sends the geographic coordinates to the server (a server that provides background services for applications installed on the mobile device and used to manage the electronic cigarette); the server queries the atmospheric pressure value corresponding to the geographic coordinates according to the geographic coordinates, and feeds back the atmospheric pressure value to the mobile device; the mobile device sends the query result carrying the atmospheric pressure value to the electronic cigarette.

In an example, before step 110 is performed, the electronic cigarette acquires the atmospheric pressure detected by the second air pressure detecting member when the electronic cigarette is turned on, and the suction force indication information is determined according to the first air pressure value and the atmospheric pressure value. In another example, in order to avoid the problem of inaccurate suction force indication information caused by movement and atmospheric pressure changes during the use of the electronic cigarette, the second air pressure detecting member detects the atmospheric pressure every predetermined period of time; and before step 110 is performed, the electronic cigarette acquires the atmospheric pressure last detected by the second air pressure detecting member, wherein the predetermined period of time can be set by the system developer or customized by the user.

Optionally, determining the suction force indication information according to the first air pressure value and the atmospheric pressure value can be achieved in the following two methods:

The first method is to calculate the difference between the first air pressure value and the atmospheric pressure value to obtain the air pressure difference, and use the air pressure difference as the suction force indication information.

The second method is to calculate the difference between the first air pressure value and the atmospheric pressure value to obtain the air pressure difference, and calculate the difference between the air pressure difference and a calibrated air pressure value to obtain the suction force indication information. The calibrated air pressure value is the air pressure difference between the air pressure in the air passage which is in communication with the mouthpiece and the atmospheric pressure when the atomizer stops working.

Specifically, the calibrated air pressure value can be preset by the system developer. Alternatively, when the atomizer stops working, the electronic cigarette can obtain the first air pressure value detected by the first air pressure detecting member, and at the same time, obtain the second air pressure value detected by the second air pressure detecting member; the difference between the first air pressure value and the second air pressure value is used as the calibrated air pressure value. For example, the electronic cigarette determines the calibrated air pressure value when the electronic cigarette is turned on according to the first air pressure value detected by the first air pressure detecting member and the second air pressure value detected by the second air pressure detecting member. Normally, when the user is not smoking, the first air pressure value detected by the first air pressure detecting member and the second air pressure value detected by the second air pressure detecting member should theoretically be the same, and both are the current atmospheric pressure. However, under the influence of many external factors such as the aging of the equipment, the first air pressure value detected by the first air pressure detecting member and the second air pressure value detected by the second air pressure detecting member may be inconsistent. In this case, the air pressure difference obtained by using the first air pressure value and the second air pressure value is inaccurate and cannot accurately reflect the user's actual suction force. Therefore, when the user is not smoking, the calibrated air pressure value is determined according to the first air pressure value detected by the first air pressure detecting member and the second air pressure value detected by the second air pressure detecting member to calibrate the air pressure difference in order to obtain an accurate air pressure difference.

Step 120: determining a target value of a working parameter of the atomizer according to the suction force indication information. The working parameter includes at least one of the output power, the temperature in the atomizing chamber, the working voltage of the atomizer, and the temperature of the heating member.

This step can be implemented in the following two methods:

In the first mothed, if the suction force indication information is greater than a start threshold and is lower than an upper threshold, then the target value of the working parameter is determined according to a first value, a second value, the start threshold, the upper threshold and the suction force indication information. If the suction force indication information reaches the upper threshold, then the second value is determined as the target value of the working parameter.

Optionally, if the suction force indication information is greater than the start threshold and is lower than the upper threshold, the target value of the working parameter is determined according to a predetermined formula, and the predetermined formula is:

$$W_3 = m\frac{W_2 - W_1}{B - A}(K - A) + W_1 + C$$

wherein $W_3$ is the target value of the working parameter, $W_1$ is the first value, $W_2$ is the second value, A is the start threshold, B is the upper threshold, K is the suction force indication information, m is not zero and is a constant, and C is a constant. For example, m can be one, and C can be zero. In addition, $W_3$ satisfies: $W_1 \leqslant W_3 \leqslant W_2$. Optionally, when the suction force indication information is equal to the start threshold, the first value is determined as the target value of the working parameter.

Optionally, when the suction force indication information is equal to the start threshold, the first value is determined as the target value of the working parameter.

Specifically, the start threshold and the upper threshold can be set by the system developer, can also be customized by the user, or can be determined by the electronic cigarette according to the atmospheric pressure. The first value is greater than or equal to the minimum value of the working parameter that the electronic cigarette can atomize the e-liquid. The second value is less than or equal to the maximum value of the working parameter supported by the electronic cigarette, and the second value is greater than the first value.

In actual implementation, the minimum value of the working parameter that can atomize the e-liquid can be directly stored in the electronic cigarette as the first value (i.e., preset by the system developer), the maximum value of the working parameter supported by the electronic cigarette is stored as the second value (i.e., preset by the system developer).

In addition, in this application, the vital capacity of the user in high-altitude areas is smaller than that in low-altitude areas. In order to reduce the difficulty for the user to trigger the atomizer to work in high-altitude areas, the start threshold can also be determined according to the atmospheric pressure, and the start threshold is positively correlated with the atmospheric pressure. In actual implementation, the start thresholds corresponding to different atmospheric pressures are obtained, and the corresponding relationship between the atmospheric pressures and the start thresholds can be stored in the electronic cigarette, wherein the corresponding relationship can be stored in the electronic cigarette in the form of a table, a curve, and the like. Similarly, the electronic cigarette can also determine the upper threshold according to the atmospheric pressure, and the upper threshold is positively correlated with the atmospheric pressure.

In an example, before determining the target value of the working parameter, the electronic cigarette can obtain the first value and/or the second value stored in the electronic cigarette.

In another example, due to the different boiling points of the e-liquid under different air pressures, the vaporization temperature of the e-liquid will also change accordingly. When the user uses the electronic cigarette in high-altitude areas, the boiling point of the e-liquid will be lower than that in low-altitude areas. During the use of the electronic cigarette in low altitude areas, in order to prevent the electronic cigarette from being unable to atomize and form smoke according to the first value of the working parameter, the first value can be determined according to the atmospheric pressure in this application, and the first value is positively correlated with the atmospheric pressure. Optionally, the amount of smoke produced by the electronic cigarette working with the same working parameter at different altitudes is also different, for example, the amount of smoke produced in high altitude areas is higher than that in low altitude areas. In order to avoid excessive smoke generation and waste of the e-liquid in high altitude areas, the present application can also determine the second value according to atmospheric pressure. Specifically, the first value is positively correlated with the atmospheric pressure, and the second value is positively correlated with the atmospheric pressure.

In actual implementation, the first values and/or the second values corresponding to different atmospheric pressures are acquired. The electronic cigarette can store the corresponding relationship between the atmospheric pressures and the first values, as well as the corresponding relationship between the atmospheric pressures and the second values, wherein these corresponding relationships can be stored in the electronic cigarette in the form of a table, a curve, or the like.

The second method is to query the target value of the working parameter corresponding to the suction force indication information, wherein the numerical relationship between the suction force indication information and the target value is the same as the aforementioned predetermined formula. The electronic cigarette can store therein a corresponding relationship between the suction force indication information and the target value of the working parameter, and the corresponding relationship can be stored in the electronic cigarette.

In the third method, when the electronic cigarette is turned on, a preset initial value of the working parameter is determined as the target value of the working parameter; and if the suction force indication information is greater than an adjustment threshold, the target value of the working parameter is increased.

Specifically, the preset initial value can be set by the system developer, or can be customized by the user. For example, the preset initial value can be the above-mentioned first value. The adjustment threshold can be set by the system developer or can be customized by the user.

Taking the output power as the working parameter and the first value is 10 watts for example, if the user uses the electronic cigarette to smoke for 5 seconds and the suction force indication information within the 5 seconds is less than the adjustment threshold, the target value of the working parameter within the 5 seconds is the preset initial value; if the user uses the electronic cigarette to smoke again for 3 seconds and increases the suction force and the suction force indication information reaches the adjustment threshold, the target value of the working parameter is increased.

Optionally, if the suction force indication information is greater than the adjustment threshold, the target value of the working parameter is increased by a predetermined adjustment step. The predetermined adjustment step can be preset by the system developer, or can be customized by the user.

Optionally, since the atmospheric pressure can also affect the user's vital capacity and the user's vital capacity is smaller in high-altitude areas, a small-step adjustment is suitable for high-altitude areas, and a large-step adjustment is suitable for low-altitude areas. Thus, the predetermined adjustment step can be determined according to the atmospheric pressure, and the predetermined adjustment step is positively correlated with the atmospheric pressure. In actual implementation, the predetermined adjustment steps corresponding to different atmospheric pressures are obtained, and the corresponding relationship between the atmospheric pressures and the predetermined adjustment steps can be stored in the electronic cigarette, wherein the corresponding relationship can be stored in the electronic cigarette in the form of a table, a curve, or the like.

Optionally, since the vital capacity of the user in high-altitude areas is relatively small, in order to reduce the difficulty for the user to trigger the electronic cigarette to increase the target value of the working parameter when the electronic cigarette is used in high-altitude areas, the adjustment threshold can be determined according to the atmospheric pressure, and the adjustment threshold is positively correlated with the atmospheric pressure. In actual implementation, the adjustment thresholds corresponding to different atmospheric pressures are obtained, and the corresponding relationship between the atmospheric pressures and the adjustment thresholds can be stored in the electronic cigarette, wherein the corresponding relationship can be stored in the electronic cigarette in the form of a table, a curve, or the like.

Optionally, since the boiling point of the e-liquid is affected by the atmospheric pressure, in order to prevent the electronic cigarette from being unable to atomize and form smoke in low-altitude areas according to the preset initial value of the working parameter, the preset initial value of the working parameter can be determined according to the atmospheric pressure, and the preset initial value is positively correlated with the atmospheric pressure. In actual implementation, the preset initial values corresponding to different atmospheric pressures are obtained, and the corresponding relationship between the atmospheric pressures and the preset initial values can be stored in the electronic cigarette, wherein the corresponding relationship can be stored in the electronic cigarette in the form of a table, a curve, or the like.

Step 130: controlling the atomizer to work according to the target value of the working parameter.

This step can be implemented in the following two methods:

The first method is to set a cigarette lighting button on the electronic cigarette, and when the electronic cigarette detects the operation signal generated by operating the cigarette lighting button, it controls the atomizer to perform atomization work. During the atomizing process of the atomizer, the atomizer is controlled to work according to the target value of the working parameter.

In the second method, there is no cigarette lighting button on the electronic cigarette; when the suction force indication information reaches the start threshold, the electronic cigarette controls the atomizer to work according to the target value of the working parameter. In this case, the number of buttons for the electronic cigarette (for example, a small cigarette) is reduced.

It should be noted that when the working parameter involved in the present application is the output power or the working voltage of the atomizer, the working voltage of the atomizer can be controlled by pulse width modulation (PWM) technology to perform step 130.

In summary, in the control method provided by the embodiment of the present disclosure, the suction force indication information is determined according to the information detected by the detecting assembly, wherein the detecting assembly includes the first air pressure detecting member arranged in the air passage communicated with the mouthpiece; the target value of the working parameter of the atomizer is determined according to the suction force indication information, wherein the working parameter includes at least one of the output power, the temperature in the atomizing chamber, the working voltage of the atomizer, and the temperature of the heating member; and the atomizer is controlled to work according to the target value of the working parameter, so as to solve the problem in the related art that the small cigarette heats and atomizes according to the preset output power to cause a single smoking taste, and accordingly achieve the effect of enriching the smoking taste of the small cigarette.

An embodiment of the present disclosure also provides a computer-readable storage medium, wherein one or more instructions are stored in the computer-readable storage medium, when the one or more instructions are executed by a processor in the electronic cigarette, the above electronic cigarette control method is performed.

An embodiment of the present disclosure also provides a control device for the electronic cigarette, the control device includes a memory and a processor; the memory stores therein at least one instruction; the processor, by loading and executing the at least one instruction, implements the above electronic cigarette control method.

Second Embodiment

Figure 2:
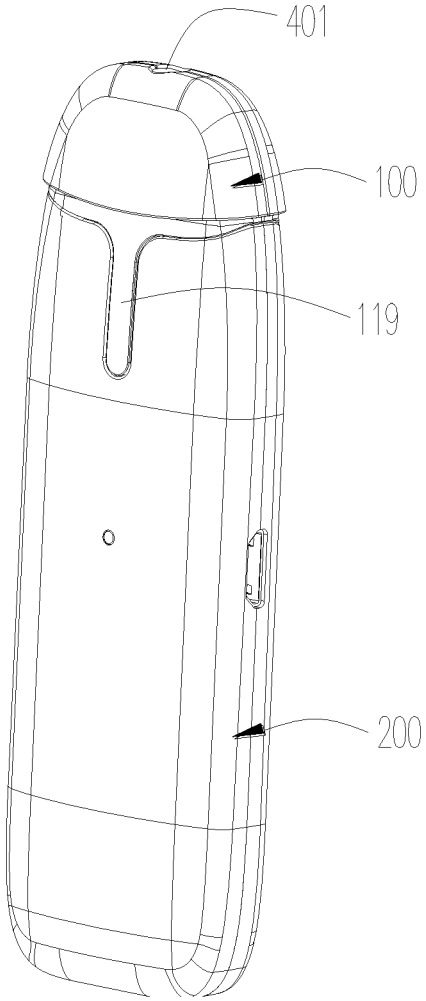
FIG. 2 is a perspective view of an electronic cigarette according to the second embodiment of the present disclosure.
Figure 3:
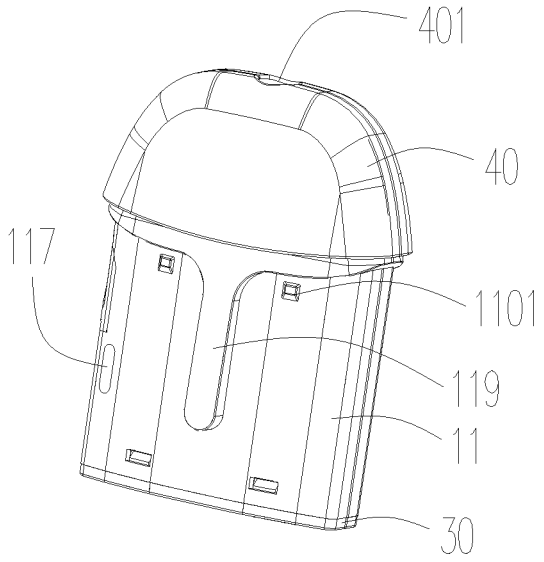
FIG. 3 is a perspective view of the cartridge of the electronic cigarette shown in FIG. 2.
Figure 4:
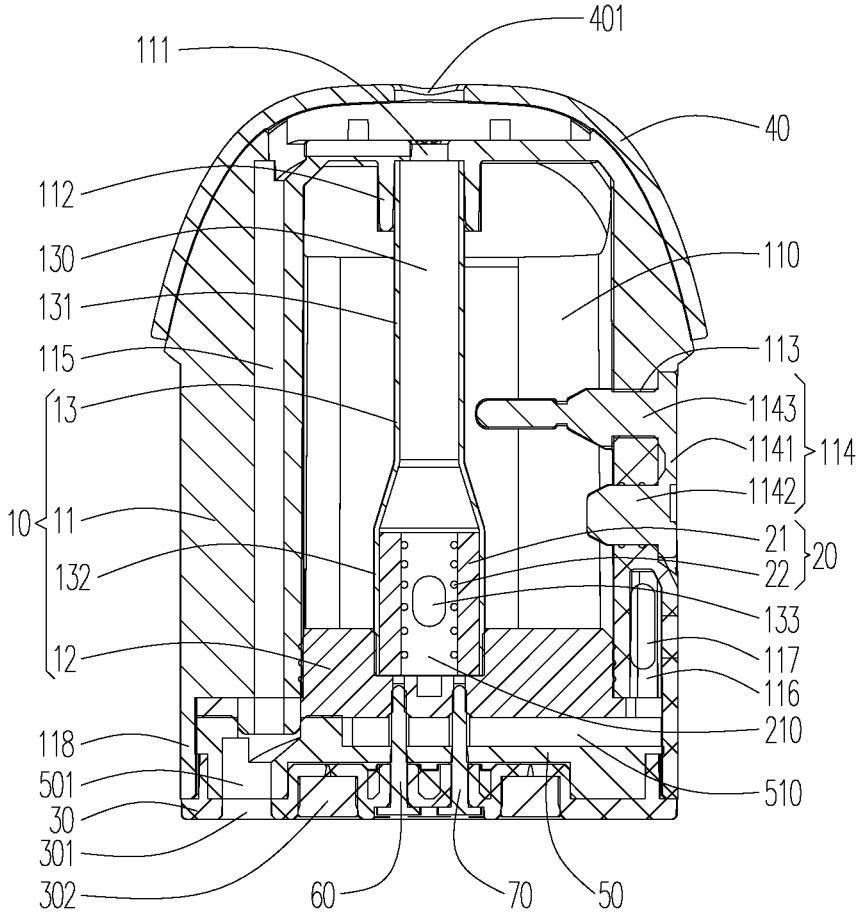
FIG. 4 is a cross-sectional view of the cartridge of the electronic cigarette shown in FIG. 3.

Please refer to FIGS. 2 to 4, the present disclosure provides an electronic cigarette. The electronic cigarette includes a cartridge 100 and a battery assembly 200 electrically connected to the cartridge 100. The cartridge 100 includes a liquid storage assembly 10 having a liquid storage chamber 110 therein, an atomizing head 20 received in the liquid storage assembly 10, a bottom base 30 installed at one end of the liquid storage assembly 10, and a mouthpiece 40 installed at the other end of the liquid storage assembly 10 opposite to the bottom base 30. In use, the atomizing head 20 heats the e-liquid stored in the liquid storage chamber 110 under the electric driving of the battery assembly 200, so that the e-liquid is heated to generate smoke for the user to inhale.

The liquid storage assembly 10 includes a cartridge casing 11, a sealing member 12 installed at one end of the cartridge casing 11, and a ventilation tube 13 received in the cartridge casing 11.

The cartridge casing 11 is substantially a hollow cylindrical structure with an opening at the lower end. The cartridge casing 11 has a flat structure, which constitutes a part of the outer contour of the cartridge 100. The width of two opposite sides of the cartridge casing 11 is larger than the width of the other two opposite sides, so that the cartridge casing 11 can be stably placed on the desktop through the sides with a larger width, which can effectively prevent the cartridge 100 from easily rolling off. The sealing member 12 is installed at the lower end of the cartridge casing 11 and closes the end opening. The ventilation tube 13 is substantially in the form of a tubular structure with both ends being opened. The ventilation tube 13 is received in the inner cavity of the cartridge casing 11, the upper end of the ventilation tube 13 is connected to the top of the cartridge casing 11, and the lower end of the ventilation tube 13 is connected to the sealing member 12. Specifically, the liquid storage chamber 110 is formed by a space surrounded by the inner wall of the cartridge casing 11, the upper end surface of the sealing member 12 and the outer peripheral surface of the ventilation tube 13. A smoke outlet passage 130 is provided in the ventilation tube 13, and the smoke outlet passage 130 is isolated from the liquid storage chamber 110 by the tube wall of the ventilation tube 13. In addition, the cartridge casing 11 is made of transparent or translucent material, so that the user can observe the amount of e-liquid in the liquid storage chamber 110 through the cartridge casing 11, which is convenient for the user to inject the liquid or replace the cartridge 100 in time. In this embodiment, the material of the cartridge casing 11 is transparent or translucent plastic.

The sealing member 12 is made of silicone material. It is understood that, in other embodiments not shown, the sealing member 12 may also be made of other sealing materials, such as rubber, to prevent the leakage of the e-liquid. In this embodiment, sealing ribs (not labeled) protrude outwards along the radial direction of the sealing member 12 on the outer peripheral surface of the sealing member 12. There are multiple sealing ribs, and the multiple sealing ribs are sequentially spaced along the axial direction of the sealing member 12. By providing the sealing ribs, multi-layer sealing of the sealing member 12 to the liquid storage chamber 110 is realized, thereby enhancing the sealing performance and further preventing the leakage of the e-liquid.

A smoke outlet hole 111 is provided on the top of the cartridge casing 11. A connecting pipe 112 is formed on the inner surface of the top wall of the cartridge casing 11 by extending downward along the axial direction of the cartridge casing 11. The upper end of the ventilation tube 13 is inserted into the connecting pipe 112, and the smoke outlet passage 130 is in communication with the smoke outlet hole 111. It can be understood that, in other embodiments not shown, the connecting pipe 112 can also be omitted. At this time, the upper end of the ventilation tube 13 is directly connected to the smoke outlet hole 111.

In this embodiment, the ventilation tube 13 includes a ventilation section 131 and a sleeve section 132 that are connected to each other. The upper end of the ventilation section 131 is connected to the top of the cartridge casing 11, and the lower end of the sleeve section 132 is connected with the sealing member 12. Specifically, the smoke outlet passage 130 is formed by the inner cavity of the ventilation section 131, the inner cavity of the sleeve section 132 forms a receiving space (not shown), and the receiving space is communicated with the smoke outlet passage 130. The atomizing head 20 is received in the receiving space. In addition, the inner diameter of the ventilation section 131 is smaller than the inner diameter of the sleeve section 132, so that the connection between the ventilation section 131 and the sleeve section 132 forms a resisting plane (not labelled), to facilitate the installation of the atomizing head 20. Specifically, the atomizing head 20 is inserted into the receiving space from the lower end of the sleeve section 132, and when the atomizing head 20 is inserted into a position in which the upper end of the atomizing head 20 resists the resisting plane, it indicates that the atomizing head 20 is installed in place. That is, the resisting plane plays a role in limiting the installation of the atomizing head 20, thereby facilitating operation for the user. In this embodiment, the ventilation section 131 and the sleeve section 132 are integrally formed. It can be understood that, in other embodiments not shown, the ventilation section 131 and the sleeve section 132 are two independent components, and when in use, they can be connected together.

When the ventilation tube 13 is installed in place, the sleeve section 132 is partially located in the liquid storage chamber 110, and the sleeve section 132 is provided with a liquid inlet hole 133 on the side wall of the portion the sleeve section 132 that is located in the liquid storage chamber 110. The liquid inlet hole 133 is respectively communicated with the liquid storage chamber 110 and the receiving space, so that the e-liquid in the liquid storage chamber 110 can flow into the receiving space through the liquid inlet hole 133, and then contact with the atomizing head 20 to participate atomizing process.

In addition, a liquid injection opening 113 is provided on the side wall of the cartridge casing 11, and the liquid injection opening 113 is communicated with the liquid storage chamber 110. The user can inject liquid into the liquid storage chamber 110 through the liquid injection opening 113. A sealing plug 114 is installed in the liquid injection opening 113 to prevent the e-liquid in the liquid storage chamber 110 from leaking through the liquid injection opening 113. Specifically, the sealing plug 114 includes a connecting portion 1141, and a fixing portion 1142 and a sealing portion 1143 respectively located at two ends of the connecting portion 1141. The fixing portion 1142 is fixedly connected to the cartridge casing 11. The sealing portion 1143 matches with the liquid injection opening 113 and is configured to seal the liquid injection opening 113. When injecting liquid, only the sealing portion 1143 is required to be taken off to expose the liquid injection port 13, while the fixing portion 1142 is kept connected with the cartridge casing 11, so that the entire sealing plug 114 does not need to be detached during the liquid injection, and it is convenient for operation and can prevent the sealing plug 114 from being lost. In order to ensure that the sealing plug 114 has good sealing performance, and the connecting portion 1141 can be elastically deformed when the sealing portion 1143 is taken off, the sealing plug 114 is an elastic member. It can be understood that, the material of the sealing plug 114 includes, but is not limited to, silicone or rubber.

In addition, a partition wall (not labeled) is provided in the cartridge casing 11 along the axial direction of the cartridge casing 11. The liquid storage chamber 110 is formed by the space enclosed by the partition wall, the inner wall of the cartridge casing 11 at one side of the partition wall, the upper end surface of the sealing member 12 and the outer peripheral surface of the ventilation tube 13. A sensing tube (not labeled) is provided along the axial direction of the cartridge casing 11 in the space formed by the partition wall and the inner wall of the cartridge casing 11 at the other side of the partition wall. The sensing tube is integrally formed with the cartridge casing 11, and a sensing cavity 115 is provided in the sensing tube. The sensing cavity 115 is located on one side of the liquid storage chamber 110 and is isolated from the liquid storage chamber 110. The upper end of the sensing cavity 115 extends through the upper end surface of the cartridge casing 11, and the lower end of the sensing cavity 115 is provided with an opening. A communication cavity 116 is provided along the axial direction of the cartridge casing 11 and located below the liquid injection opening 113 in the side wall of the cartridge casing 11 opposite to the sensing cavity 115 (i.e., in the side wall of the cartridge casing 11 with the liquid injection opening 113). The cartridge casing 11 is provided with an air inlet hole 117 corresponding to the communication cavity 116. The upper end of the communication cavity 116 is in communication with the air inlet hole 117, and the lower end of the communication cavity 116 extends through the lower end surface of the cartridge casing 11.

The atomizing head 20 includes a liquid guiding member 21 and a heating member 22 which are in contact with each other. The liquid guiding member 21 and the heating member 22 are both received in the receiving space. The liquid guiding member 21 has the ability to absorb e-liquid. The heating member 22 can generate heat after being energized. In this embodiment, the liquid guiding member 21 is a hollow structure with both ends penetrating through, and the inner cavity of the liquid guiding member 21 forms the atomizing chamber 210. The liquid guiding member 21 is made of a porous material. The porous material has air permeability to allow air to pass through. When the liquid guiding member 21 is in an absorption saturated state, it will not further absorb the e-liquid, thereby sealing the e-liquid in the liquid storage chamber 110; when the heating member 22 heats the e-liquid on the liquid guiding member 21, the liquid guiding member 21 can absorb the e-liquid in the liquid storage chamber 110 again. In this embodiment, the liquid guiding member 21 is wrapped around the outside of the heating member 22 and attached to the inner wall of the sleeve section 132 corresponding to the liquid inlet hole 133, so that the e-liquid in the liquid storage chamber 110 is absorbed into the atomizing chamber 210 by the liquid guiding member 21 through the liquid inlet hole 133.

In this embodiment, the heating member 22 is a spiral heating wire, and the liquid guiding member 21 is cotton. It is understood that in other embodiments not shown, the heating member 22 may also be a conductive paste, a heating tube, a heating net, etc. The liquid guiding member 21 can also be a fiber rope, sponge, porous ceramic, porous graphite, foamed metal, etc., and the heating member 22 can also be arranged in the liquid guiding member 21, which is not limited here.

Please refer to FIG. 4 again, the periphery of the lower end of the cartridge casing 11 extends downward along the axial direction of the cartridge casing 11 to form a connecting barrel 118, and the inner diameter of the connecting barrel 118 is larger than the inner diameter of the liquid storage chamber 110. In this embodiment, the connecting barrel 118 and the cartridge casing 11 are integrally formed. It is understood that, in other embodiments not shown, the connecting barrel 118 and the cartridge casing 11 are two independent components, and they are connected together when in use.

The bottom base 30 is installed at the lower end of the connecting barrel 118. In this embodiment, the bottom base 30 is clamped to the connecting barrel 118. It is understood that in other embodiments not shown, the bottom base 30 and the connecting barrel 118 can also be connected in a detachable manner such as screw connection, plugging connection, and magnetic connection, which is not limited here.

An inner lining member 50 is installed inside the connecting barrel 118, the outer peripheral surface of the inner lining member 50 is connected in a sealed fit with the inner peripheral surface of the connecting barrel 118, the lower end surface of the inner lining member 50 is attached to the upper end surface of the bottom base 30 and connected together. An air passage gap 510 is formed between the upper end surface of the inner lining member 50 and the lower end surface of the sealing member 12. One end of the air passage gap 510 is in communication with the lower end opening of the communication cavity 116, and the other end of the air passage gap 510 is in communication with the atomizing chamber 210. Specifically, the part of the sealing member 12 below the atomizing head 20 is provided with a ventilation groove (not labeled). One end of the ventilation groove is in communication with the atomizing chamber 210, and the other end of the ventilation groove is in communication with the air passage gap 510. That is, the air passage gap 510 is in communication with the atomizing chamber 210 through the ventilation groove.

Specifically, the inner lining member 50 has a substantially plate-like structure. A portion of the upper end surface of the inner lining member 50 seals against the lower end surface of the cartridge casing 11 corresponding to the sensing cavity 115, and another portion of the upper end surface of the inner lining member 50 is recessed downward to form a groove (not labeled). Both ends of the groove are respectively in communication with the atomizing chamber 210 and the communication cavity 116. The air passage gap 510 is formed by the space enclosed by the bottom wall of the groove and the lower end surface of the sealing member 12. In this embodiment, the inner lining member 50 is made of silicone to improve air tightness. It can be understood that, in other embodiments not shown, the inner lining member 50 can also be made of other sealing materials such as rubber.

The inner lining member 50 is provided with a first through hole 501 corresponding to the lower end of the sensing cavity 115. The bottom base 30 is provided with a second through hole 301 corresponding to the first through hole 501. The sensing cavity 115 is in communication with the first through hole 501 and the second through hole 301 in sequence, and the lower end of the second through hole 301 extends through the lower end surface of the bottom base 30. It can be understood that, the inner lining member 50 is configured to isolate the sensing cavity 115 from the airflow passage (the air inlet hole 117, the communication cavity 116, the air passage gap 510, the ventilation groove, the atomizing chamber 210 and the smoke outlet passage 130 are communicated in sequence to form the airflow passage), to prevent the airflow in the sensing cavity 115 and the airflow in the airflow passage from interfering with each other.

The cartridge 100 of the present disclosure also includes a first electrode 60 and a second electrode 70 mounted on the bottom base 30. Specifically, the upper end of the first electrode 60 passes through the bottom base 30 and the inner lining member 50 in sequence and then is inserted into the sealing member 12. The upper end of the second electrode 70 passes through the bottom base 30 and the inner lining member 50 in sequence and then is inserted into the sealing member 12. There heating member 22 has two pins. The upper end of each of the first electrode 60 and the second electrode 70 is provided with an opening. One of the pins is inserted into the opening of the first electrode 60, and then a clamping force is applied to the first electrode 60, so that the opening of the first electrode 60 shrinks inward to clamp the pin. Similarly, the other pin is inserted into the opening of the second electrode 70, and then a clamping force is applied to the second electrode 70, so that the opening of the second electrode 70 shrinks inward to clamp the other pin. It can be understood that, in other embodiments not shown, one pin may also be sandwiched between the first electrode 60 and the sealing member 12, and the other pin is sandwiched between the second electrode 70 and the sealing member 12. In use, the first electrode 60 and the second electrode 70 are respectively connected to the positive and negative electrodes of the battery assembly 200. The battery assembly 200 supplies power to the heating member 22, and the heating member 22 heats the e-liquid absorbed by the liquid guiding member 21, to atomize the e-liquid into smoke. In addition, the bottom base 30, the inner lining member 50 and the sealing member 12 are all made of insulating materials to prevent short-circuit failure between the first electrode 60 and the second electrode 70. In this embodiment, the bottom base 30 is made of plastic.

The mouthpiece 40 is installed at the upper end of the cartridge casing 11. In this embodiment, the mouthpiece 40 is sleeved outside the upper end of the cartridge casing 11. Specifically, the mouthpiece 40 is substantially a hollow cylindrical structure with an opening at the lower end. The outer wall of the cartridge casing 11 is provided with a first latching groove (not shown), the inner wall of the mouthpiece 40 is convexly provided with a first buckle (not shown) corresponding to the first latching groove. When the mouthpiece 40 and the cartridge casing 11 are installed in place, the first latching groove and the first buckle are engaged with each other, so as to achieve a stable connection relationship between the mouthpiece 40 and the cartridge casing 11. When the mouthpiece 40 and the cartridge casing 11 are installed in place, the first latching groove and the first buckle are both covered by the outer wall of the mouthpiece 40, so that the whole cartridge 100 is more beautiful. In this embodiment, there are two first latching grooves, and the two first latching grooves are provided on opposite sides of the cartridge casing 11, respectively. Correspondingly, there are two first buckles, so that the connection between the mouthpiece 40 and the cartridge casing 11 can be made more stable and reliable. It can be understood that, in other embodiments not shown, the first buckle is provided on the inner wall of the mouthpiece 40, and the first latching groove is provided on the outer wall of the cartridge casing 11. It can be understood that, in other embodiments not shown, the mouthpiece 40 and the cartridge casing 11 can also be detachably connected by screw connection, plugging connection, magnetic connection, etc. The detachable structure of the mouthpiece 40 facilitates the cleaning of the mouthpiece 40 and improves the hygiene during use. It can be understood that, in other embodiments not shown, the mouthpiece 40 can also be arranged to be non-detachable from the cartridge casing 11. That is, once the mouthpiece 40 is connected to the cartridge casing 11, the mouthpiece 40 cannot be detached.

A smoke outlet opening 401 is provided at the center of the upper end surface of the mouthpiece 40. The smoke outlet opening 401 is in communication with the external atmosphere and the inner cavity of the mouthpiece 40. When the mouthpiece 40 and the cartridge casing 11 are installed in place, the upper end of the sensing cavity 115 is in communication with the smoke outlet opening 401, and the smoke outlet hole 111 is in communication with the smoke outlet opening 401, so that the sensing cavity 115 and the smoke outlet passage 130 are each in communication with the smoke outlet opening 401. It can be understood that, in other embodiments not shown, the mouthpiece 40 can be omitted, and the upper end of the cartridge casing 11 can be directly used as a mouthpiece.

Figure 5:
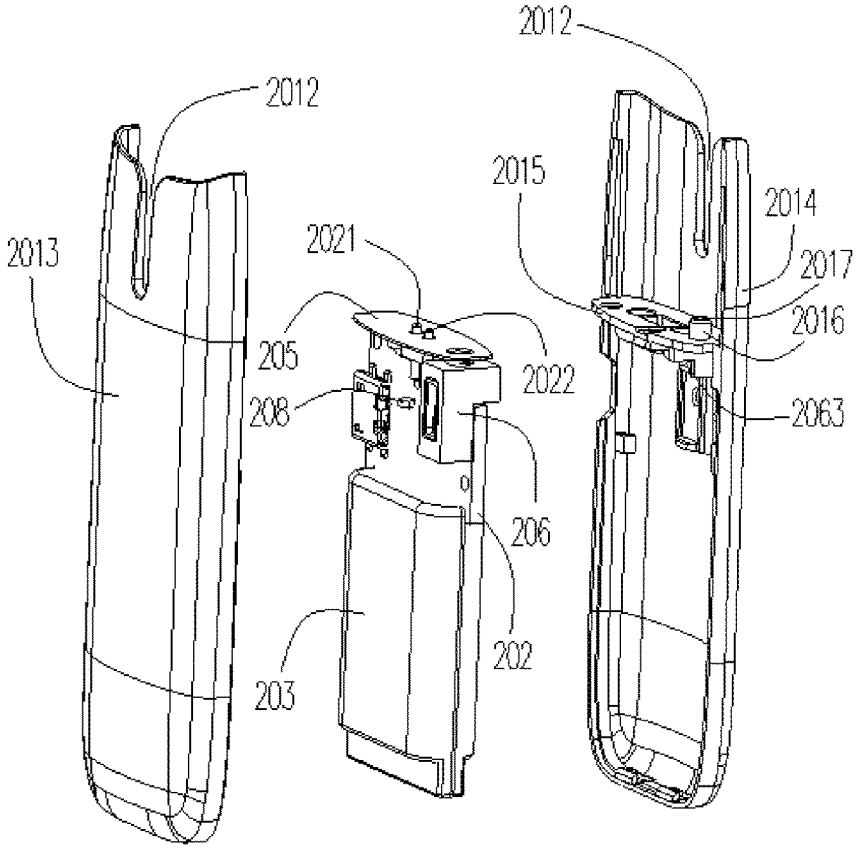
FIG. 5 is an exploded view of the battery assembly of the electronic cigarette shown in FIG. 2.
Figure 6:
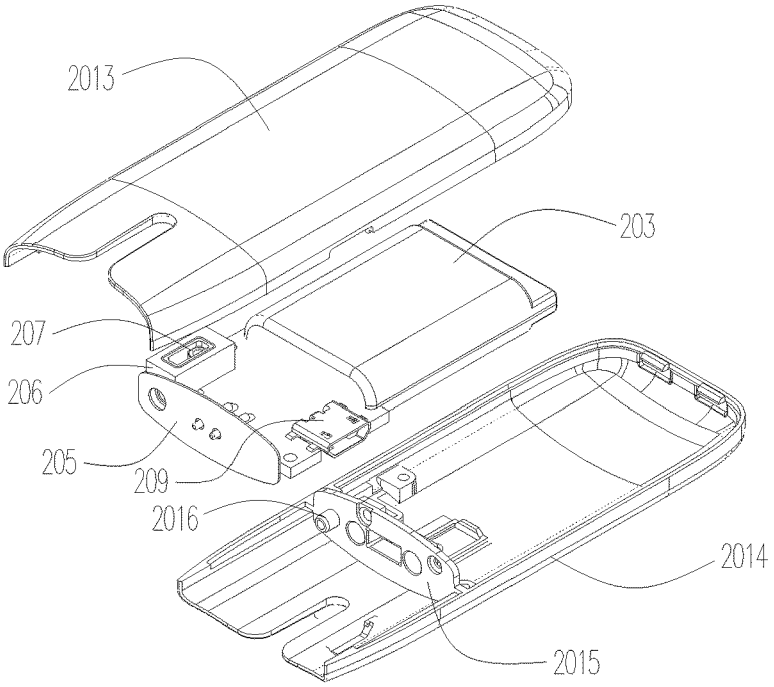
FIG. 6 is an exploded view of the battery assembly of the electronic cigarette shown in FIG. 2 from another perspective.

Referring to FIGS. 5 and 6, the battery assembly 200 includes a battery casing 201, a control board 202 received in the battery casing 201, and a battery 203 installed in the battery casing 201 and located under the control board 202. It can be understood that, the cartridge casing 11 and the battery casing 201 together constitute an outer casing of the electronic cigarette.

The battery casing 201 is substantially a hollow cylindrical structure with an opening at the upper end. The inner cavity of the battery casing 201 forms a receiving chamber 2011. The lower end of the cartridge casing 11 of the cartridge 100 is detachably installed in the upper end of the receiving chamber 2011. In this embodiment, the upper end surface of the battery casing 201 is recessed downward along the axial direction of the battery casing 201 to form oppositely disposed guiding grooves 2012. The outer wall of the cartridge casing 11 is protruded to provide with a sliding guide rib 119 that cooperates with the guiding groove 2012. During the process of installing the cartridge 100 into the receiving chamber 2011, the two sides of the sliding guide rib 119 can slide along the two opposite walls of the guiding groove 2012, so as to guide the installation of the cartridge 100. When the cartridge 100 is installed in place, the sealing plug 114 is shielded, so that the user cannot inject liquid by opening the sealing plug 114 without pulling out the cartridge 100. At the same time, only the mouthpiece 40 is exposed out of the receiving chamber 2011 for the user to suck conveniently, and the overall length of the electronic cigarette is short for the user to carry conveniently. In this embodiment, the sliding guide rib 119 is made of transparent or translucent materials, and the user can observe the amount of e-liquid in the liquid storage chamber 110 through the sliding guide rib 119, which is convenient for the user to inject liquid or replace the cartridge 100. In this embodiment, the material of the sliding guide rib 119 is transparent or translucent plastic, and the sliding guide rib 119 is integrally formed with the cartridge casing 11.

Figure 10:
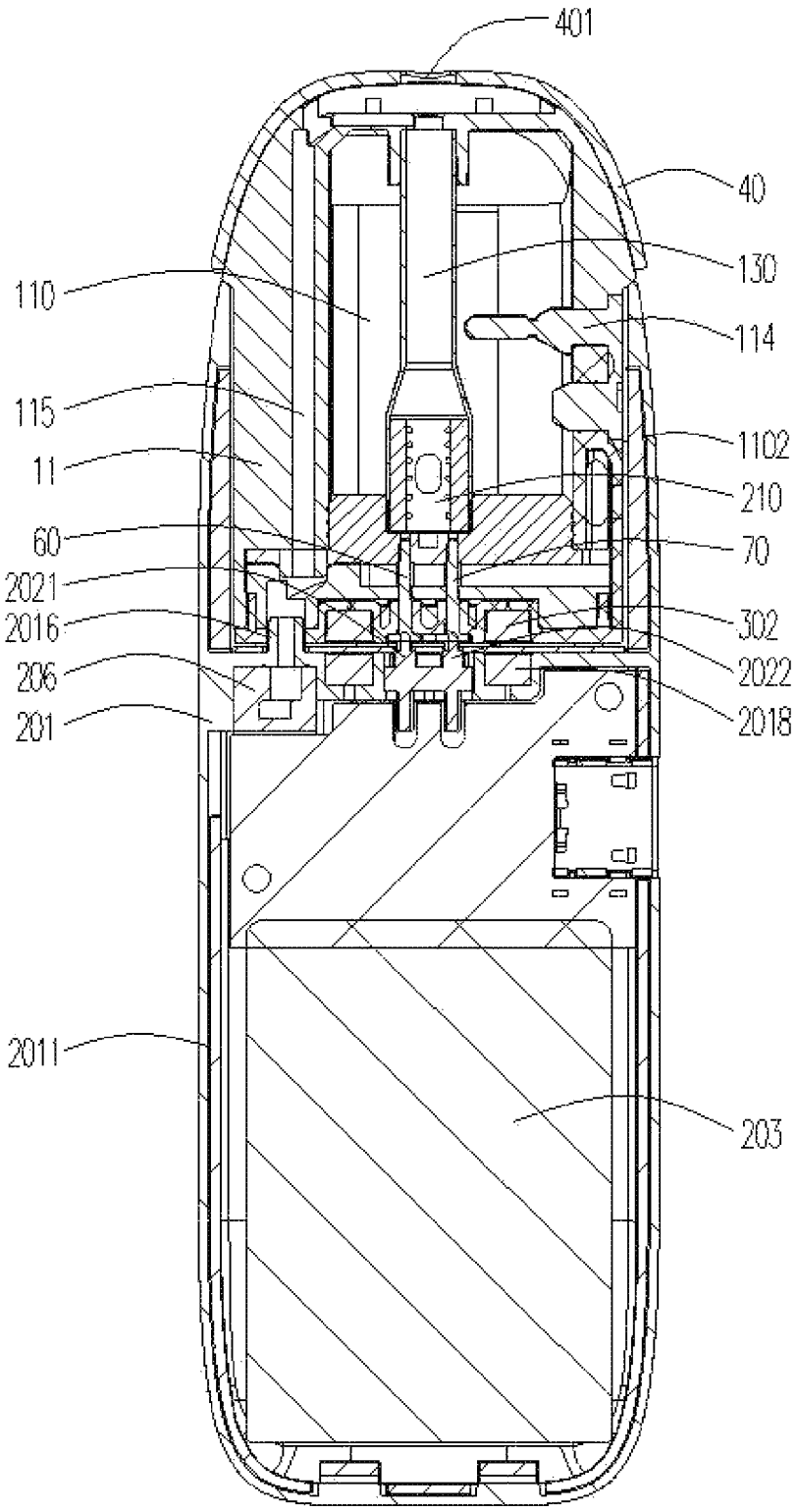
FIG. 10 is a cross-sectional view of the electronic cigarette shown in FIG. 2.

In addition, please refer to FIGS. 3 and 10, the outer wall of the cartridge casing 11 is protruded to provide with a protrusion 1101. When the cartridge 100 is installed in place, one end of the protrusion 1101 away from the cartridge casing 11 abuts against the inner wall of the battery casing 201, so that a ventilation gap 1102 is formed between the outer wall of the cartridge casing 11 and the inner wall of the battery casing 201, and the ventilation gap 1102 is in communication with one end of the air inlet hole 117 away from the communication cavity 116 and the external atmosphere. Thus, when the user sucks, the external air enters the atomizing chamber 210 through the ventilation gap 1102, the air inlet hole 117, the communication cavity 116, the air passage gap 510 and the ventilation groove in sequence, and is mixed with the smoke; then, the mixed gas enters the user's mouth through the smoke outlet passage 130, the smoke outlet hole 111 and the smoke outlet opening 401 in sequence.

After the cartridge casing 11 is connected to the battery casing 201, the cartridge 100 and the battery assembly 200 are connected together. It can be understood that, due to the resisting effect of the protrusion 1101 on the battery casing 201, there is an interactive supporting force between the cartridge casing 11 and the battery casing 201, to ensure a stable connection between the cartridge casing 11 and the battery casing 201, and prevent the cartridge 100 from being easily separated from the battery assembly 200.

In this embodiment, the battery casing 201 includes a first shell 2013 and a second shell 2014. The first shell 2013 and the second shell 2014 are detachably connected or fixedly connected. The first shell 2013 and the second shell 2014 are connected to form a cylindrical structure with an opening at the upper end. The receiving chamber 2011 is cooperatively defined by the inner wall of the first shell 2013 and the inner wall of the second shell 2014. One of the two guiding grooves 2012 is provided in the first shell 2013, and the other one is provided in the second shell 2014. The battery casing 201 is formed by connecting the first shell 2013 and the second shell 2014 together, which facilitates processing and production. In this embodiment, the first shell 2013 and the second shell 2014 are snapped together. It can be understood that in other embodiments not shown, the first shell 2013 and the second shell 2014 may also be detachably connected by screw connection, plugging connection, magnetic connection, or the like. It can be understood that, in other embodiments not shown, the battery casing 201 can also be integrally formed.

A fixing plate 2015 is formed on the inner wall of the second shell 2014 along the radial direction of the battery casing 201. An air guiding post 2016 is protruded to provide on the upper end surface of the fixing plate 2015 corresponding to the second through hole 301. The air guiding post 2016 is provided with an air guiding hole 2017 along its own axis. The air guiding hole 2017 extends through the lower end surface of the fixing plate 2015. When the cartridge 100 is installed in place, the upper end of the air guiding post 2016 is inserted into the second through hole 301 and the first through hole 501 in sequence, the air guiding hole 2017 is in communication with the lower end of the sensing cavity 115. In this embodiment, the fixing plate 2015 and the second shell 2014 are integrally formed. It can be understood that, in other embodiments not shown, the fixing plate 2015 and the second shell 2014 can also be separate components, and in use, the fixing plate 2015 can be connected to the second shell 2014. In addition, the air guiding post 2016 allows the cartridge 100 to be inserted into the battery assembly 200 only in one direction, otherwise, the cartridge 100 will be resisted by the air guiding post 2016, making the cartridge 100 unable to be inserted smoothly. When the cartridge 100 is inserted smoothly, the air guiding post 2016 must have be inserted into the second through hole 301 and the first through hole 501 in sequence, to ensure that when the cartridge 100 is installed in place, the air guiding hole 2017 is in communication with the sensing cavity 115. In addition, the plug-in design of the air guiding post 2016 can improve the sealing performance.

In addition, a first magnetic member 2018 is installed on the upper end surface of the fixing plate 2015, and a second magnetic member 302 is installed on the lower end surface of the bottom base 30. When the cartridge 100 is installed in place, the first magnetic member 2018 and the second magnetic member 302 are attracted with each other, thereby ensuring that the cartridge 100 and the battery assembly 200 are not easily separated. It is understood that, in other embodiments not shown, the cartridge 100 and the battery assembly 200 can also be connected in a detachable manner such as screw connection, snapping connection, etc., which is not limited here.

The control board 202 is received in the receiving chamber 2011 and located below the fixing plate 2015. The battery 203 is installed in the receiving chamber 2011 and located under the control board 202. A first terminal 2021 and a second terminal 2022 are installed on the upper end of the control board 202. The upper end of the first terminal 2021 and the upper end of the second terminal 2022 both extend through the fixing plate 2015, wherein the first terminal 2021 is electrically connected to one of the positive and negative electrodes of the battery 203, and the second terminal 2022 is electrically connected to the other of the positive and negative electrodes of the battery 203. When the cartridge 100 and the battery assembly 200 are installed in place, the first terminal 2021 is in contact with and electrically connected to the first electrode 60, and the second terminal 2022 is in contact with and electrically connected to the second electrode 70, thereby enabling the battery assembly 200 to electrically drive the heating member 22.

In addition, a partition plate 205 is further installed on the upper end surface of the fixing plate 2015. The upper end of the first terminal 2021 and the upper end of the second terminal 2022 both extend through the partition plate 205.

The air guiding post 2016 passes through the through hole on the partition plate 205 and then is inserted into the second through hole 301 and the first through hole 501 in sequence. The partition plate 205 shields the control board 202, the battery 203 and the first magnetic member 2018 which are located under the partition plate 205, which not only makes the battery assembly 200 more beautiful, but also improves the safety of the battery assembly 200 in use. The first magnetic member 2018 is sandwiched between the partition plate 205 and the fixing plate 2015, so that the installation of the first magnetic member 2018 is more reliable. The thickness of the partition plate 205 is appropriate, therefore, the magnetic attraction of the first magnetic member 2018 to the second magnetic member 302 is not affected.

Figure 7:
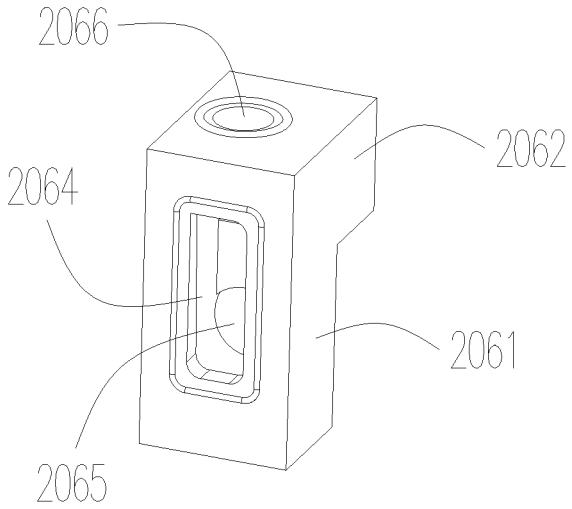
FIG. 7 is a schematic diagram of the airtight member in the battery assembly shown in FIG. 5.
Figure 8:
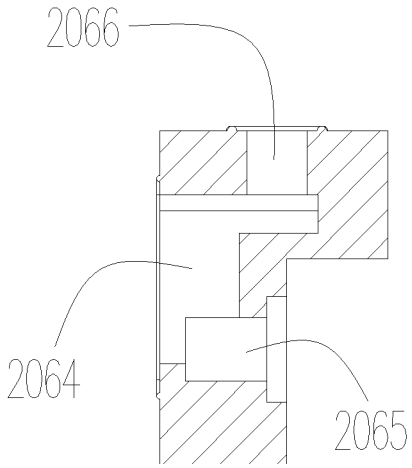
FIG. 8 is a cross-sectional view of the airtight member shown in FIG. 7.

Please refer to FIGS. 6 to 8, an airtight member 206 is installed on the control board 202. The airtight member 206 includes a longitudinal connecting block 2061 and a horizontal connecting block 2062 that are connected with each other. The longitudinal connecting block 2061 is arranged along the axial direction of the electronic cigarette. The horizontal connecting block 2062 is arranged along the radial direction of the electronic cigarette. One end of the horizontal connecting block 2062 is connected to one end of the longitudinal connecting block 2061, so that the airtight member 206 has substantially an inverted L-shaped structure. The connection between the longitudinal connecting block 2061 and the horizontal connecting block 2062 forms a right-angle structure (not labelled), so that the airtight member 206 is hung on the upper end of the control board 202, and a side surface of the control board 202 is attached to a surface of the longitudinal connecting block 2061. At the same time, the lower end surface of the fixing plate 2015 is provided with a mounting groove 2063 corresponding to the air guiding hole 2017 and in communication with the air guiding hole 2017. One end of the horizontal connecting block 2062 away from the longitudinal connecting block 2061 matches with the mounting groove 2063 and can be inserted into the mounting groove 2063. It can be understood that, the horizontal connecting block 2062 is mounted to the mounting groove 2063, which limits the movement tendency of the airtight member 206 along the longitudinal direction of the electronic cigarette. The longitudinal connecting block 2061 is connected with the control board 202 to limit the movement tendency of the airtight member 206 along the radial direction of the electronic cigarette. As a result, the position of the airtight member 206 is restricted to fix the airtight member 206. It should be noted that, the one end of the horizontal connecting block 2062 away from the longitudinal connecting block 2061 is disposed adjacent to the second shell 2014, the surface of the longitudinal connecting block 2061 away from the horizontal connecting block 2062 is disposed adjacent to the first shell 2013.

Figure 9:
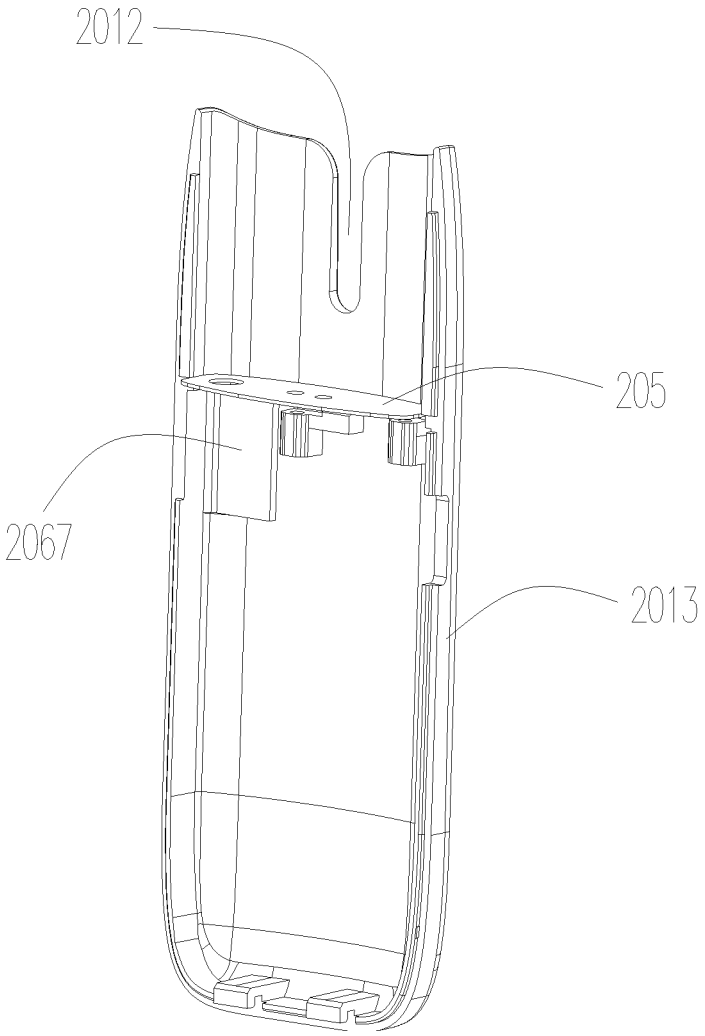
FIG. 9 is a schematic diagram of the first shell in the battery assembly shown in FIG. 5.

The surface of the longitudinal connecting block 2061 adjacent to the first shell 2013 is recessed to form an opening 2064. A mounting hole 2065 is recessed on the surface of the longitudinal connecting block 2061 through which the longitudinal connecting block 2061 is attached to the control board 202. The top surface of the horizontal connecting block 2062 is recessed downward to form a communication opening 2066. The control board 202 is covered on the mounting hole 2065, one end of the mounting hole 2065 away from the control board 202 is in communication with the opening 2064, the communication opening 2066 is in communication with the opening 2064. In addition, referring to FIG. 9, a cover plate 2067 is provided on the first shell 2013 corresponding to the opening 2064. When the first shell 2013 and the second shell 2014 are installed in place, the cover plate 2067 is covered on the opening 2064 to close the opening 2064; thus, the mounting hole 2065, the communication opening 2066 and the opening 2064 form a communication passage (not labeled) with only one end thereof being opened. Specifically, the communication opening 2066 is the open end of the communication passage. The mounting hole 2065, the opening 2064, the communication opening 2066 and the sensing cavity 115 jointly form a sensing passage (not labeled). In this embodiment, the airtight member 206 is integrally formed, and the airtight member 206 is made of silicone or rubber material to improve the air tightness and prevent air leakage. The outer surface of one end of the horizontal connecting block 2062 far away from the longitudinal connecting block 2061 is tightly attached to the groove wall of the mounting groove 2063. The communication opening 2066 is aligned with and in communication with the air guiding hole 2017.

The electronic cigarette of the present disclosure further includes a first air pressure detecting member 207 and a second air pressure detecting member 208 both of which are installed on the control board 202. The first air pressure detecting member 207, the second air pressure detecting member 208 and the battery 203 are all electrically connected to the control board 202. The first air pressure detecting member 207 is installed in the sensing passage and communicated with the sensing passage. Specifically, in this embodiment, the mounting end of the first air pressure detecting member 207 is mounted on the control board 202, and the detecting end of the first air pressure detecting member 207 is installed in the mounting hole 2065 and communicated with the sensing passage for detecting the air pressure value p1 in the sensing passage. The second air pressure detecting member 208 is arranged on the control board 202 and located outside the sensing passage, and is communicated with the outside atmosphere for detecting the atmospheric pressure value p2 of the current environment of the electronic cigarette. It can be understood that, in other embodiments not shown, the second air pressure detecting member 208 can also be omitted. For example, a memory is provided on the control board 202, and the atmospheric pressure value p2 of the atmospheric pressure is stored in the memory. For another example, a receiver is provided on the control board 202, and the receiver is configured to receive the atmospheric pressure value p2 sent by an external device.

It can be understood that, in other embodiments not shown, the airtight member 206 can also be omitted. At this time, the upper end of the sensing cavity 115 extends through the upper end surface of the cartridge casing 11, the lower end of the sensing cavity 115 is closed, the sensing passage is formed by the sensing cavity 115, and the first air pressure detecting member 207 is installed in the sensing cavity 115 and communicated with the sensing cavity 115.

It can be understood that, in other embodiments not shown, when the opening 2064 does not extend through the surface of the longitudinal connecting block 2061, the cover plate 2067 can be omitted.

In this embodiment, the battery assembly 200 includes a USB socket 209 provided on the control board 202, and a USB connection port (not labeled) is provided on the second shell 2014 corresponding to the USB socket 209. On the one hand, the user uses a USB data cable to connect to an external power source for charging through the USB connection port and the USB socket 209, or connect to an external smart device for data interaction; on the other hand, the second air pressure detecting member 208 communicates with the outside atmosphere through the USB connection port and the USB socket 209. It is understood that, in other embodiments not shown, a connection port may be directly opened on the battery casing 201, so that the second air pressure detecting member 208 communicates with the outside atmosphere through the connection port.

In this embodiment, the mouthpiece 40 is only in communication with the sensing passage and the airflow passage, and is not in communication with the second air pressure detecting member 208. Through isolation by the partition plate 205, the bottom base 30, etc., the second air pressure detecting member 208 is not in communication with the mouthpiece 40, and the airflow generated by the suction cannot be detected by the second air pressure detecting member 208 during the smoking, to ensure that the second air pressure detecting member 208 accurately detects the atmospheric pressure value without being affected by the user's suction at the mouthpiece 40.

When in use, the control board 204 can execute the control method described in the first embodiment, and then automatically control the output power of the battery 203 according to the difference between p1 and p2.

Specifically, when the electronic cigarette is not working, the first air pressure detecting member 207 obtains p1, the second air pressure detecting member 208 obtains p2, the difference s between p1 and p2 is calculated. The difference s is used to calibrate the air pressure during suction in order to avoid inaccurate air pressure due to the factors of the air pressure detection members themselves.

When the user sucks, the difference s is subtracted from the difference between detected p1 and p2 to obtain the actual pressure difference K to measure the user's current suction force.

A startup threshold A and an upper threshold B are preset on the control board 204. When K=A, it is judged that it can be sucked to avoid false triggering, and the initial power $W_1+C$ is output. When K>B, the maximum power $W_2$ is output. When K>A and K<B, the output power is automatically adjusted according to the pressure difference K, and at this time, the output power is:

$$W_3 = m\frac{W_2 - W_1}{B - A}(K - A) + W_1 + C$$

wherein $W_3$ is the output power of the atomizing head, $W_1$ is the first value, $W_2$ is the second value, A is the start threshold, B is the upper threshold, K is the difference between the air pressure value p1 in the sensing passage detected by the first air pressure detecting member and the atmospheric pressure value p2 of the environment of the electronic cigarette detected by the second air pressure detecting member, or the difference after air pressure calibration; m is not zero and is a constant, C is a constant. The first value $W_1$ is greater than or equal to the minimum value of the output power that the electronic cigarette can atomize the e-liquid. The second value $W_2$ is less than or equal to the maximum output power supported by the electronic cigarette. The second value $W_2$ is greater than the first value $W_1$. In addition, the output power $W_3$ of the atomizing head satisfies: $W_1 \leq W_3 \leq W_2$.

In this embodiment, the first air pressure detecting member 207 and the second air pressure detecting member 208 are each an air pressure sensor. The control board 204 is also provided with a USB socket 209. The open end of the USB socket 209 is exposed to the outside of the battery casing 201, on the one hand, it is used to charge the battery 203, and on the other hand, the inside of the battery assembly 200 is kept in communication with the outside atmosphere through the USB socket 209, so that the inside of the battery assembly 200 maintains a normal pressure.

The electronic cigarette provided by the present disclosure, the air pressure value p1 in the sensing passage and the air pressure value p2 of the current environment are respectively acquired, in order to obtain the user's suction force. Therefore, the battery assembly 200 can adjust the output power based on different suction forces, so as to allow the user to obtain different tastes and meet the needs of different users.

The above-mentioned embodiments merely represent several implementations of the present application, and the descriptions thereof are more specific and detailed, but they shall not be understood as a limitation on the scope of the present application. It should be noted that, for those of ordinary skill in the art, variations and improvements may still be made without departing from the concept of the present application, and all of which shall fall into the protection scope of the present application. Therefore, the scope of protection of the present application shall be subject to the appended claims.

What is claimed is:

1. An electronic cigarette comprising a casing assembly; an atomizing head, a sensing passage, a control board, a battery and a first air pressure detecting member are arranged in the casing assembly; the battery, the atomizing head and the first air pressure detecting member are each electrically connected to the control board; a detection end of the first air pressure detecting member is arranged in the sensing passage for detecting the air pressure value p1 in the sensing passage; the casing assembly is provided with a mouthpiece in communication with the sensing passage, when smoking through the mouthpiece, the control board adjusts the output power of the battery to the atomizing head according to the difference between the air pressure value p1 in the sensing passage detected by the first air pressure detecting member and an atmospheric pressure value p2 of the atmospheric pressure;

a memory is provided on the control board, the atmospheric pressure value p2 of the atmospheric pressure is stored in the memory: or, a receiver is provided on the control board, the receiver receives the atmospheric pressure value p2 sent from an external device: or, the electronic cigarette further comprises a second air pressure detecting member, the second air pressure detecting member is in communication with the outside atmosphere and detects the atmospheric pressure value p2 of the atmospheric pressure;

the electronic cigarette comprises a cartridge and a battery assembly; the cartridge comprises a cartridge casing, the battery assembly comprises a battery casing, the cartridge casing and the battery casing together form the casing assembly; the atomizing head is received in the cartridge casing; the battery, the control board, the first air pressure detecting member and the second air pressure detecting member are all received in the battery casing: the mouthpiece is arranged at one end of the cartridge casing; one end of the cartridge casing opposite to the mouthpiece is detachably inserted into the battery casing to cause the cartridge to be detachably connected with the battery assembly.

2. The electronic cigarette according to claim 1, wherein said the control board adjusting the output power of the battery to the atomizing head according to the difference between the air pressure value p1 in the sensing passage detected by the first air pressure detecting member and the atmospheric pressure value p2 of the atmospheric pressure, comprises:

determining the output power of the atomizing head according to a predetermined formula, and the predetermined formula is:

$$W_3 = m\frac{W_2 - W_1}{B - A}(K - A) + W_1 + C$$

wherein $W_3$ is the output power of the atomizing head, $W_1$ is a first value, $W_2$ is a second value, A is a start threshold, B is an upper threshold, K is the difference between the air pressure value p1 in the sensing passage detected by the first air pressure detecting member and the atmospheric pressure value p2 of the atmospheric pressure, m is not zero and is a constant, and C is a constant; the first value is greater than or equal to a minimum value of the output power that the electronic cigarette can atomize the e-liquid, the second value is less than or equal to a maximum value of the output power supported by the electronic cigarette, and the second value is greater than the first value.

3. The electronic cigarette according to claim 1, wherein a sensing cavity is provided in the cartridge casing along the axial direction of the cartridge casing, the battery assembly further comprises an airtight member, the airtight member is provided with a communication passage, the communication passage has an opening; when the cartridge is connected to the battery assembly, the opening of the communication passage is aligned with and in communication with the sensing cavity; the first air pressure detecting member is installed on the control board and the detection end of the first air pressure detecting member is arranged in the communication passage, the sensing passage comprises the sensing cavity and the communication passage.

4. The electronic cigarette according to claim 3, wherein a liquid storage chamber which is isolated from the sensing cavity is further provided in the cartridge casing along the axial direction of the cartridge casing; the cartridge further comprises a sealing member arranged at one end of the cartridge casing opposite to the mouthpiece and configured for sealing the liquid storage chamber; one end of the cartridge casing opposite to the sealing element is provided with a smoke outlet hole, the mouthpiece is provided with a smoke outlet opening, the sensing cavity is in communication with the smoke outlet opening through the smoke outlet hole.

5. The electronic cigarette according to claim 4, wherein the cartridge further comprises an inner lining member provided at one end of the cartridge casing opposite to the mouthpiece, the inner lining member is located below the sealing member, an air passage gap is formed between the inner lining member and the sealing member, a communication cavity is provided in the side wall of the cartridge casing opposite to the sensing cavity, the cartridge casing is further provided with an air inlet hole in communication with the communication cavity, the atomizing head is at least partially received in the liquid storage chamber, the atomizing head is provided with an atomizing chamber, one end of the air passage gap is in communication with the communication cavity, and the other end of the air passage gap is in communication with the atomizing chamber.

6. The electronic cigarette according to claim 5, wherein a receiving chamber is provided in the battery casing, the cartridge casing is partially received in the receiving chamber, the outer wall of the cartridge casing is protruded to provide with a protrusion, the protrusion abuts against the inner wall of the battery casing, a ventilation gap is formed between the outer wall of the cartridge casing and the inner wall of the battery casing, the ventilation gap is in communication with the external atmosphere and the air inlet hole.

7. The electronic cigarette according to claim 5, wherein the cartridge further comprises a bottom base installed at one end of the cartridge casing opposite to the mouthpiece and located below the inner lining member, and a first electrode and a second electrode; the atomizing head comprises a liquid guiding member and a heating member which are in contact with each other; one end of the first electrode extends through the bottom base and the inner lining member in sequence, and is inserted into the sealing member and is electrically connected to one pin of the heating member; one end of the second electrode extends through the bottom base and the lining member in sequence, and is inserted into the sealing member and is electrically connected to the other pin of the heating member.

8. The electronic cigarette according to claim 1, wherein a USB socket is installed on the control board, a USB connection port is provided on the battery casing, the second air pressure detecting member is in communication with the outside atmosphere through the USB socket and the USB connection port in sequence.

* * * * *